US008162419B2

(12) United States Patent
Dellby et al.

(10) Patent No.: US 8,162,419 B2
(45) Date of Patent: Apr. 24, 2012

(54) BASKET LIFTING ARRANGEMENT FOR A DISHWASHER

(75) Inventors: Fredrik Dellby, Älvsjö (SE); Fredrik Bergling, Nyhamnsläge (SE); Gregory Peake, Kingsford (AU)

(73) Assignee: Electrolux Home Products Corporation N.V., Zaventem (BE)

( * ) Notice: Subject to any disclaimer, the term of this patent is extended or adjusted under 35 U.S.C. 154(b) by 740 days.

(21) Appl. No.: 11/568,262

(22) PCT Filed: Apr. 7, 2005

(86) PCT No.: PCT/SE2005/000515

§ 371 (c)(1),
(2), (4) Date: Sep. 22, 2008

(87) PCT Pub. No.: WO2005/104924

PCT Pub. Date: Nov. 10, 2005

(65) Prior Publication Data

US 2009/0009040 A1 Jan. 8, 2009

(30) Foreign Application Priority Data

Apr. 29, 2004 (SE) ..... 0401122-7

(51) Int. Cl.
*A47B 81/00* (2006.01)

(52) U.S. Cl. ..... 312/228.1; 312/311; 312/312

(58) Field of Classification Search ..... 312/228.1, 312/228, 271, 272, 272.5, 273–276, 310–312, 312/319.5, 306, 334.4, 247; 211/41.2, 41.8; 134/57 D, 56 D, 135, 200; 422/297, 300, 301; 108/108, 110; 414/331.04, 331.14
See application file for complete search history.

(56) References Cited

U.S. PATENT DOCUMENTS

| | | | | | |
|---|---|---|---|---|---|
| 3,321,261 | A | * | 5/1967 | Guth | 312/269 |
| 3,466,108 | A | * | 9/1969 | Guth | 312/274 |
| 3,472,573 | A | * | 10/1969 | Geiger | 312/351 |
| 3,726,580 | A | * | 4/1973 | Guth | 312/351 |
| 3,736,037 | A | * | 5/1973 | Doepke | 312/351 |
| 3,761,153 | A | * | 9/1973 | Guth | 312/351 |
| 3,768,883 | A | * | 10/1973 | Kauffman | 312/351 |
| 3,794,400 | A | * | 2/1974 | Guth | 312/269 |
| 3,822,085 | A | * | 7/1974 | Clark | 312/351 |
| 5,115,822 | A | | 5/1992 | Nichols | |

(Continued)

FOREIGN PATENT DOCUMENTS

JP 10-179495 7/1998

*Primary Examiner* — James O Hansen
*Assistant Examiner* — Sasha T Varghese
(74) *Attorney, Agent, or Firm* — Pearne & Gordon LLP

(57) ABSTRACT

A dishwasher includes a wash cabinet having a bottom, two opposite side walls, an upper and a rear wall and an opening that normally is covered by a front door. The dishwasher is provided with at least one lower basket for the dish being cleaned, said basket being movable between a first position inside the cabinet and a second position mainly outside the cabinet. The dishwasher is at each side of the opening provided with a support arranged to move mainly vertically in or close to the side walls for raising the lower basket from a lower to an upper position and vice versa. The supports are articulated by a lifting mechanism arranged to move the supports from an inactive position out of engagement with the lower basket to an active position in which they are in engagement with the lower basket.

11 Claims, 3 Drawing Sheets

U.S. PATENT DOCUMENTS 5,226,706 A * 7/1993 Tuller ..... 312/228
5,595,200 A * 1/1997 Favaro ..... 134/201
5,896,703 A * 4/1999 Wright et al. ..... 49/339
5,971,513 A 10/1999 Cassalia
5,980,006 A * 11/1999 Wilhelmstatter et al. .. 312/319.1
6,247,771 B1 6/2001 Miller
6,510,858 B1 1/2003 Halstead et al.
2003/0042825 A1 3/2003 Welch et al.

* cited by examiner

BASKET LIFTING ARRANGEMENT FOR A DISHWASHER

TECHNICAL FIELD

This invention relates to a dishwasher comprising a wash cabinet having a bottom, two opposite side walls, an upper and a rear wall and an opening that normally is covered by a front door; the dishwasher being provided with at least one lower basket for a dish being cleaned, said basket being movable between a first position inside the cabinet and a second position mainly outside the cabinet, the dishwasher at each side of the opening being provided with a support arranged to move mainly vertically in or close to the side walls for raising the lower basket from a lower to an upper position and vice versa.

BACKGROUND ART

Household dishwashers of the floor standing type having means for lifting the lower basket in order to make it easier to load or unload the basket are previously known in the art. The major part of such known devices are provided with torque link arrangements, see for instance U.S. Pat. No. 5,115,822, arrangements for lifting the door together with the basket, see U.S. Pat. No. 6,510,858, or manually operated swing arm systems, see JP 10-179495. These arrangements have however proved to be unsatisfactory with regard to stability and safety and moreover the arrangements are rather complicated and hence expensive. It is also previously known to provide a dishwasher with a height adjustment mechanism for an intermediate basket that is placed between a lower and an upper basket, see US 2003/0042825. This mechanism is provided with means at each side for supporting the guide rails on which the basket rests. The arrangement is primarily intended for adjusting the space above or below the intermediate basket in order to make it possible to wash dishes having different sizes and the arrangement has a limited vertical movement possibility.

BRIEF SUMMARY OF THE INVENTION

The purpose of this invention is to create an ergonomic lifting arrangement for a lower dishwasher basket making it possible for the operator to easily pick out the dish from the basket without the need for bending his back. An additional purpose is to create an arrangement that is stable and safe to use as well as simple and reliable. This is achieved by means of an arrangement having the characteristics mentioned in the claims.

BRIEF DESCRIPTION OF THE SEVERAL VIEWS OF THE DRAWINGS

An embodiment of the invention will now be described with reference to the accompanying drawings on which FIG. 1 schematically shows a perspective view of a dishwasher with the lower basket in a lower position, FIG. 2 is a perspective view of the dishwasher with the lower basket in a lifted up position whereas

DETAILED DESCRIPTION OF THE INVENTION

Figure 1:
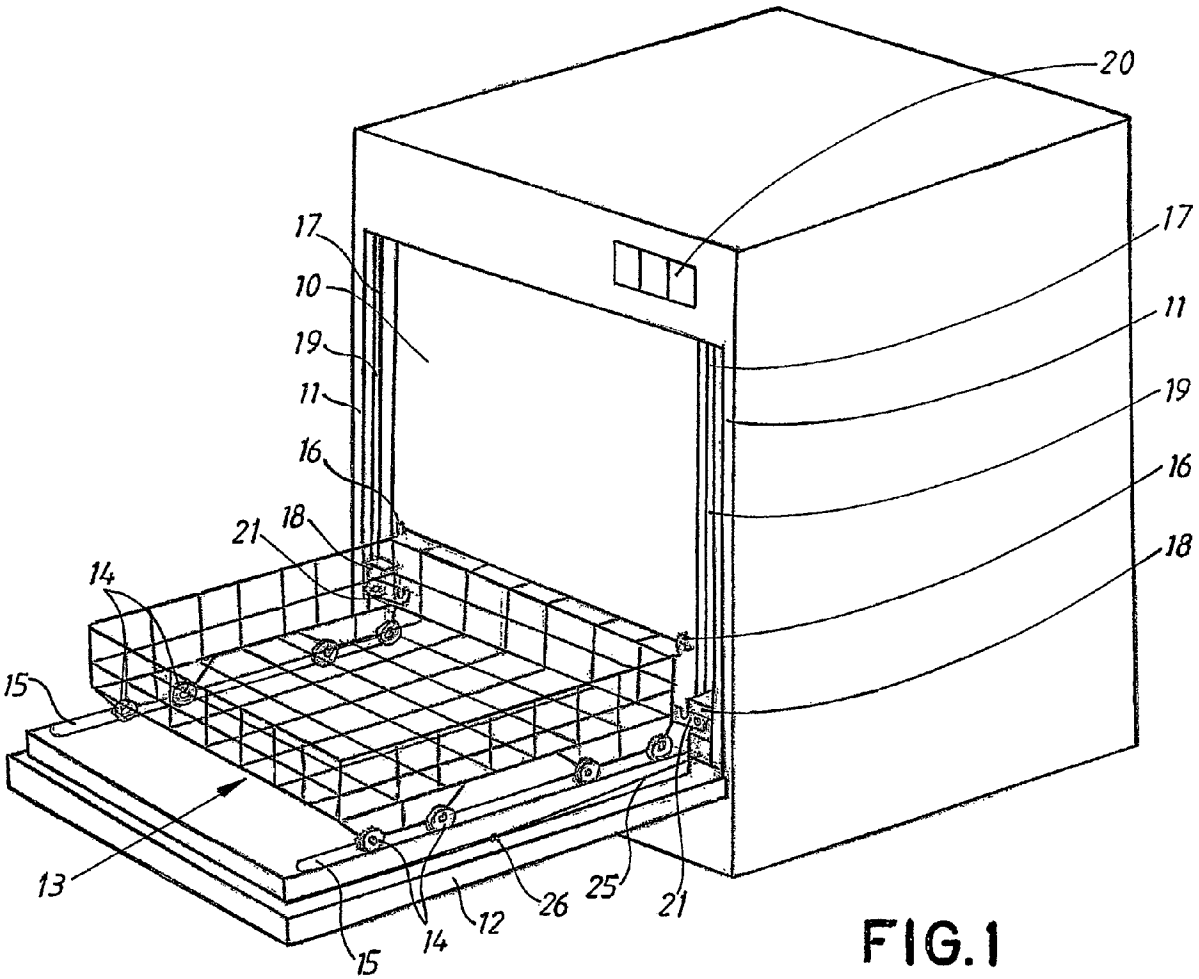
Figure 2:
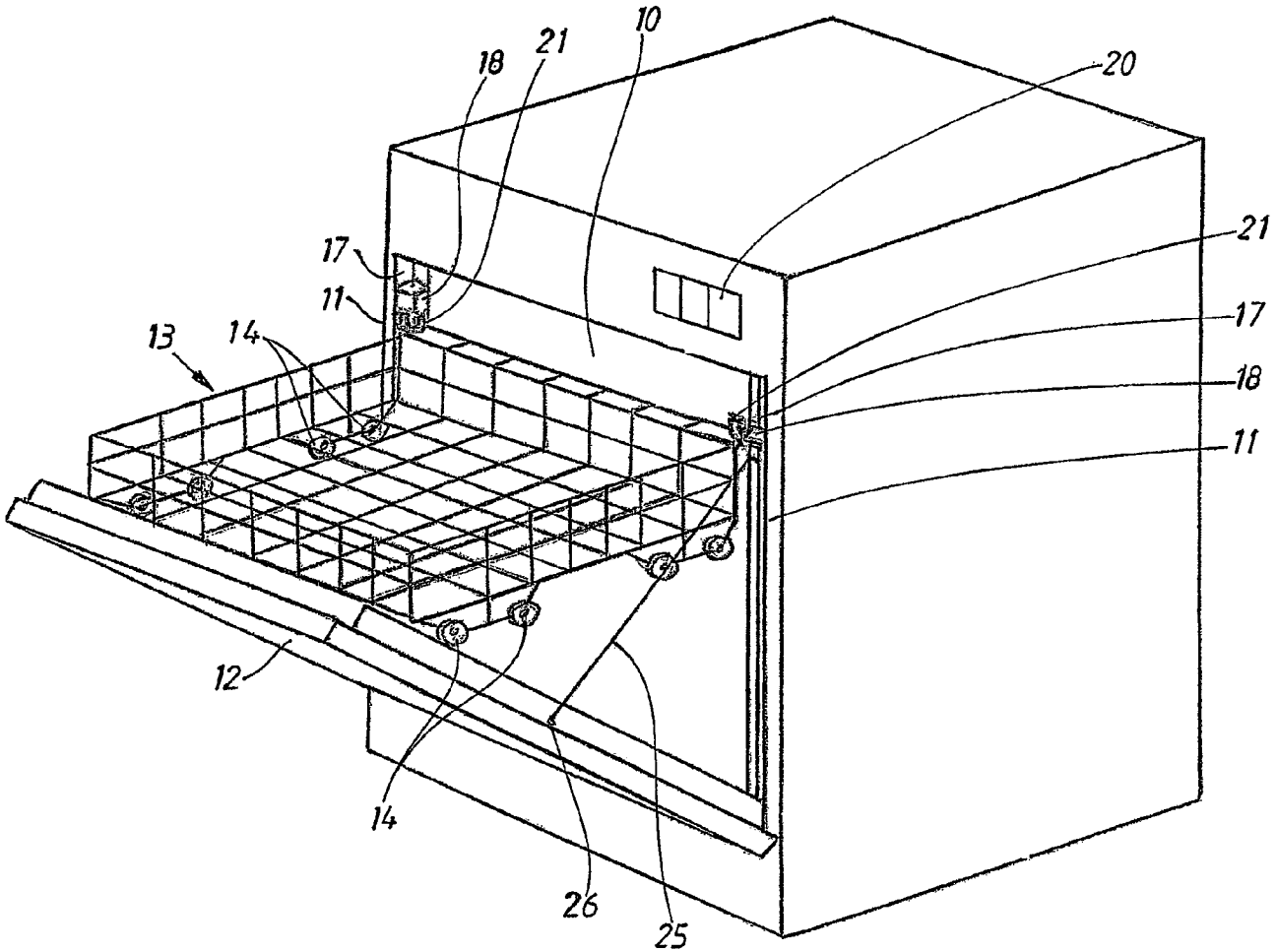

As it appears from FIG. 1 the dishwasher comprises a wash cabinet 10 provided with a bottom, two side walls 11, an upper and a rear wall and an opening that normally is covered by a front door 12. An upper and a lower basket 13 (upper basket not shown) are provided in the cabinet and the baskets can be pulled out from their position within the cabinet to a position outside the cabinet. The dishwasher is in a conventional way also provided with rotating wash arms, filter means, a circulating pump, an outlet pump and mechanical and electrical control means for distributing cleaning liquid into the cabinet as well as to circulate the liquid in the cabinet in order to clean the dish which is placed on the baskets before the liquid is emptied from the cabinet. The last mentioned means are however not shown and described in detail since they are not a part of the present invention.

The lower basket 13 which is provided with several rollers 14 can be pulled out from the cabinet 10 by the operator such that the wheels are guided in elongated recesses 15 arranged on the inner side of the door 12 when the door is in a folded down, mainly horizontal position. The lower basket 13 is at its innermost end and at each side provided with a U-shaped catch portion 16 the purpose of which will be explained below.

Figure 3:
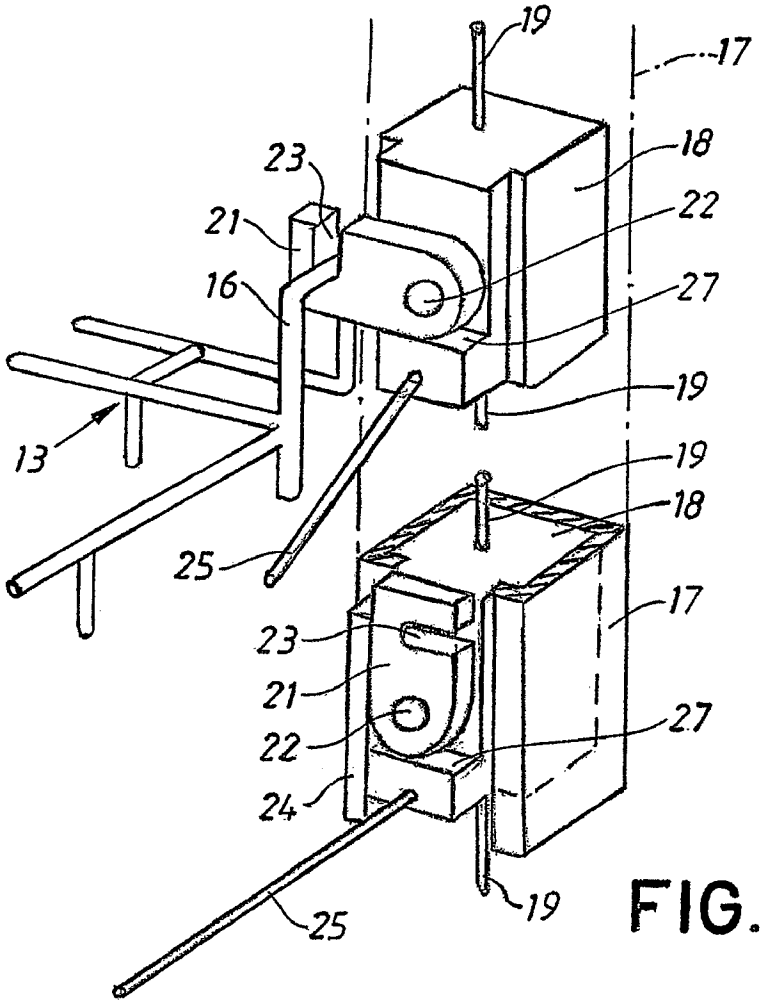
FIG. 3 is a partly broken perspective view showing a part of the lifting mechanism in two different positions.

Each side wall 11 is at its front part provided with a C-shaped rail 17 extending almost from the bottom of the cabinet to its top and in which a slider 18 is guided for vertical motion. The slider can be raised and lowered by means of a wire 19 that via pulleys (not shown) mounted in the side walls are connected to an electric motor (not shown) that can be activated by a control means 20. At each end of at least one of the rails 17 there is a switch (not shown) stopping the upwards or downwards movement of the slider 18. The slider 18 is at its front side provided with a support such as spring loaded arm 21 that can be turned about an axis 22 and has a hook 23. The arm can be turned from an upright position, see the lower part of FIG. 3, in which the arm rests against a forwardly extending flange portion 24 of the rail 17 to a folded out position, see the upper part of FIG. 3, in which the arm rests against a shoulder 27 of the slider 18.

The dishwasher is further provided with two wires 25 each having one end secured to one of the sliders 18 whereas the other end is secured to a spring (not shown) arranged within the door 12. The wires 25 run freely through apertures 26 at the side edges of the door 12 and are articulated by the spring but the pull out motion of the wires from the door is restricted by separate stop members (not shown), secured to the wire inside the door, or the spring which engage the door wall when the wires have been pulled out to their end positions.

The arrangement operates in the following manner. When picking out the dish from the lower basket the operator pulls out the lower basket 13 from the cabinet 10 and the rolls 14 are thus running in the elongated recesses 15 on the door 12. Then the operator pushes the control means 20 such that the electric motor of the winding arrangement is started which causes the wires 19 to simultaneously lift the sliders 18 from their lower position illustrated in the bottom of FIG. 3 to a somewhat raised position shown in the upper part of the same figure. Because of the spring forces acting on the arms 21 and the successive rising motion above the upper end of the flanges 24 the arms gradually are turned and finally reach their folded out positions in which the arms rest on the shoulders 27 of the sliders 18. Further rising motion of the sliders 18 means that the hooks 23 arranged on the arms 21 move into the catch portions 16 of the basket 13 and start to lift the inner end of the basket.

Simultaneously the wires 25 are gradually pulled out from the door 12 through the apertures depending on the wire interconnection with the sliders 18 until the stop members on the wire engage the inside wall of the door. Then the door starts to turn upwards at the same time as the front rollers 14 start to roll upwards in the recesses 15. Thus, continued raising of the sliders 18 causes the basket to be gradually lifted. When the sliders reach the upper position of the rails the switches will stop the electric motor and hence the basket will now be in a lifted up position such that it is easy to pick out the dish.

Instead of supporting the basket at the front side by the door and at the rear side by the support arms it is also possible to use solely one support arm at each side of the basket. These support arms could for instance be hidden in the side walls of the dishwasher when not being activated and be folded out when being activated such that they come into engagement with the basket and lift the basket to an upper position.

The invention claimed is:

1. A dishwasher comprising a wash cabinet having a bottom, two opposite side walls, an upper and a rear wall and an opening that normally is covered by a front door the dishwasher being provided with at least one lower basket for a dish being cleaned, said basket being movable between a first position inside the cabinet and a second position substantially outside the cabinet, the dishwasher at each side of the opening being provided with a support arranged to move substantially vertically in or close to the side walls for raising the lower basket from a lower to an upper position and vice versa characterized in that the supports each comprise a hook and are articulated by a lifting mechanism arranged to move the supports from an inactive position in which the hooks are disengaged from the lower basket to an active position in which the hooks are in engagement with a catch portion of the lower basket.

2. A dishwasher according to claim 1 wherein the support is a turnable or extendable arm.

3. A dishwasher according to claim 2 wherein the arm is spring loaded and cooperates with a flange that turns the arm from a horizontal to a vertical position when the lifting mechanism reaches its lower position.

4. A dishwasher according to claim 1 wherein the lifting mechanism is operatively coupled to a control mechanism.

5. A dishwasher according to claim 4 wherein the control mechanism via a wire system is connected to the lifting mechanism.

6. A dishwasher according to claim 1 wherein the lifting mechanism comprises a slider that is guided substantially vertically by a rail.

7. A dishwasher according to claim 1 wherein the raising motion of the supports is synchronized with a door turning motion and wherein the basket is supported by said supports as well as the door.

8. A dishwasher according to claim 7 wherein the door is connected to the lifting mechanism via a mechanical connection.

9. A dishwasher according to claim 8 wherein the mechanical connection is a wire.

10. A dishwasher according to claim 9 wherein the door is provided with an aperture through which the wire runs into the door.

11. A dishwasher comprising:

a wash cabinet having a bottom, two opposite side walls, an upper and a rear wall and an opening configured to be covered by a front door;

at least one lower basket configured to support at least one dish, said basket being movable between a first position inside the cabinet and a second position substantially outside the cabinet, first and second rails provided at each side of the opening, respectively, the first and second rails extending from almost a bottom of the cabinet to the top of the cabinet;

first and second supports coupled to the first and second rails, respectively, the first and second supports being configured to vertically move along the first and second rails to move the lower basket between a lower position and an upper position; and a lifting mechanism configured to move the supports from an inactive position, with the supports being out of engagement with a catch portion of the lower basket, to an active position, with the supports being in engagement with the catch portion of the lower basket.

* * * * *